US006237803B1

(12) United States Patent
Sarnoff et al.

(10) Patent No.: US 6,237,803 B1
(45) **Date of Patent: *May 29, 2001**

(54) ROASTING AND PAN/COVER ASSEMBLY

(75) Inventors: Norton Sarnoff, Northbrook; Kraig Fletcher, Kildeer, both of IL (US)

(73) Assignee: Handi-Foil Corporation, Wheeling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/497,329

(22) Filed: Feb. 3, 2000

Related U.S. Application Data

(63) Continuation of application No. 09/136,216, filed on Aug. 19, 1998, now Pat. No. 6,065,629.

(51) Int. Cl.[7] ..... B65D 25/22

(52) U.S. Cl. ..... 220/743; 220/573.1; 220/491; 220/647; 220/318

(58) Field of Search ..... 220/743, 573.1, 220/573.5, 573.4, 491, 485, 4.24, 23.91, 647, 912, 318, 315, 646, 756, 759; 99/426

(56) References Cited

U.S. PATENT DOCUMENTS

| | | | | |
|---|---|---|---|---|
| 2,336,699 | * | 12/1943 | Neth et al. | 220/4.24 |
| 3,972,318 | * | 8/1976 | Lenoir | D7/354 |
| 4,717,038 | * | 1/1988 | Anders | 220/769 |
| 4,852,760 | * | 8/1989 | Sarnoff et al. | 220/491 |
| 4,969,569 | * | 11/1990 | Anders | 220/629 |
| 4,971,216 | * | 11/1990 | Fortune | 220/573.1 |
| 5,029,721 | * | 7/1991 | Timpe | 220/769 |
| 5,203,254 | * | 4/1993 | Fletcher | 220/756 |
| 5,339,728 | * | 8/1994 | Marchwiak et al. | 220/912 |
| 5,503,062 | * | 4/1996 | Buff, IV | 220/756 |
| 5,950,838 | * | 9/1999 | Fletcher et al. | 206/775 |
| 6,065,629 | * | 5/2000 | Sarnoff et al. | 220/315 |

* cited by examiner

*Primary Examiner*—Stephen Castellano
(74) *Attorney, Agent, or Firm*—Robert F. I. Conte; Lee, Mann, Smith, McWilliams, Sweeney & Ohlson

(57) ABSTRACT

An assembly of a formed wire roasting rack, a roasting pan and a foil cover, each of which is removable from the rack. Each of the pan and cover has a base, an upstanding sidewall, a rim and a peripheral bead formation surrounding the rim. The rack has a first pair of parallel elongated wire form sections terminating in upwardly extending portions providing outwardly extending wire handles, and a second elongated wire form section extending transverse to the first wire section and terminating in an upwardly extending portion at each end. At each end thereof, a bead gripping formation is provided. The bead gripping formations are sized and proportioned to grippingly retain the pair of pan and cover bead formations when one of the pan and covers is inverted to overlie and cover the other.

8 Claims, 6 Drawing Sheets

ROASTING AND PAN/COVER ASSEMBLY

This is a continuation of my application Ser. No. 09/136,216 filed Aug. 19, 1998 now U.S. Pat. No. 6,065,629 granted May 23, 2000.

BACKGROUND OF THE INVENTION

Aluminum foil pans are widely used for cooking, baking and roasting since they are very efficient in quickly distributing heat and are also inexpensive, thus making them disposable. A wide variety of shapes and sizes of aluminum foil pans have been developed for use with food items to be cooked or baked or roasted in an oven. Generally, such pans have upper rims which add rigidity and strength to the pans. Also, stamped formations are typically provided in the bottom wall and creases are formed in the sidewall of the pan for additional reinforcement. To provide still further strength and stability, especially when foil pans are used for baking or roasting heavier items, such as turkeys, hams, roasts, etc., holders or racks for supporting disposable aluminum foil pans are now fairly widely used in association with the pans.

Frequently such holders and racks are permanently combined with a pan for one-time use and disposal. Such assemblies are available in the marketplace and typical such assemblies are illustrated inpatents such as U.S. Pat. Nos. 4,852,760; 4,029,721; and D-333,235. In the latter case the disposable pan is removably secured to the rack. It would be desirable to provide an improved rack and pan assembly which is readily adaptable to marketing and shipping as a combined rack, pan and cover assembly, and which facilitates usage of the rack with both a pan and an overlying cover.

SUMMARY OF THE INVENTION

In accordance with the present invention, an assembly comprising a formed wire roasting rack and a pair of formed foil roasting pan/cover members removably secured thereto, is provided. Each roasting pan/cover member has a base, an upstanding sidewall, a rim and a peripheral bead formation surrounding the rim. The roasting rack comprises a first pair of parallel elongated wire form sections terminating in upwardly extending portions providing outwardly extending wire handles, and second elongated wire form section a extending to the first wire section and transverse terminating in an upwardly extending portion at each end, each upwardly extending portion providing bead gripping a formation at the free end thereof, and an actuator for retracting the bead gripping formation. The wire form sections are adapted to support a base in use, the upwardly extending portions are adapted to support and nestingly extending portions are receive the sidewall, and the bead gripping formations are sized and proportioned to grippingly retain a pair of roasting pan/cover member bead formations, all in a nested array, to grippingly retain the pair of roasting pan/cover bead formations when one of the pan/covers is inverted to overlie and cover the other, and to release the pan/cover member bead formations for removal from the rack when an actuator is retracted.

The roasting pan/cover members may be substantially identical. The bead gripping formation desirably comprises an inwardly opening gripper means which preferably comprises a pair of laterally spaced inwardly opening loops.

The actuator is connected to each of the pair of inwardly opening loops.

In preferred form the second wire form member a comprises a pair of elongated parallel wire form sections, each terminating in an upwardly extending portion at each end, each providing a bead gripping formation at the free end thereof, and wherein the bead gripping formations comprises an inwardly opening gripper means.

In one form the pan upstanding sidewall defines outwardly projecting handles formed at each side of the pan/cover the handles being adapted to be positioned between pairs of the upwardly extending wire portions to prevent lateral movement of a pan/cover member relative to the wire roasting rack. Most preferably the handles are positioned between the parallel second wire form sections.

Further objects, features and advantages of the present invention will become apparent from the following description and drawings.

DETAILED DESCRIPTION

Figure 1:
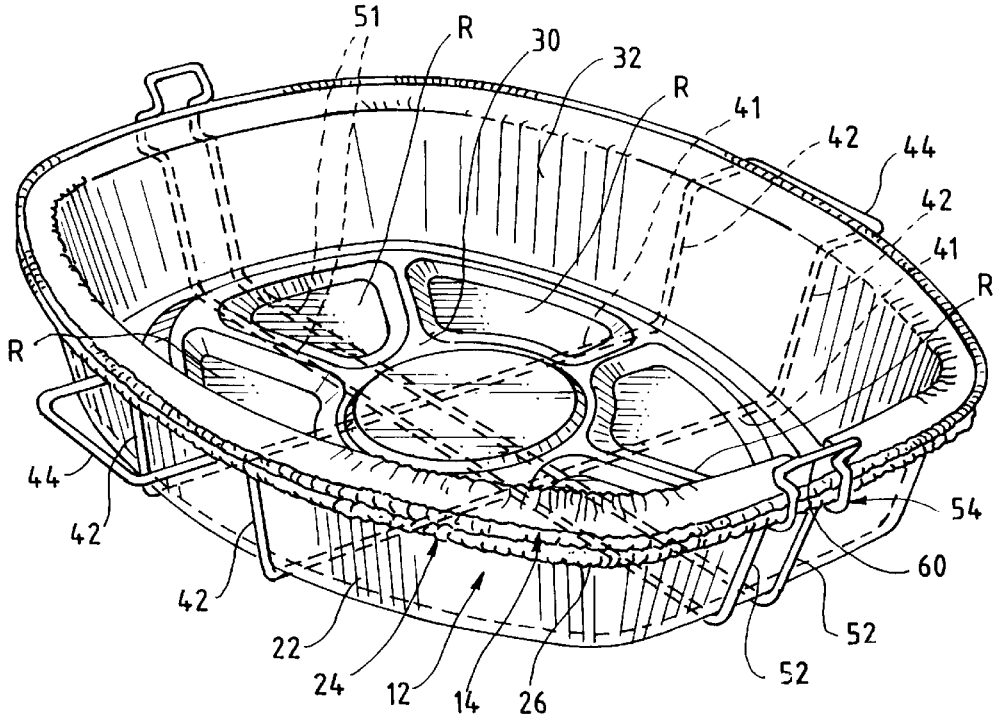
FIG. 1 is a perspective view of a first embodiment of an assembly of a formed wire roasting rack and associated roasting pan/cover members of the present invention.
Figure 2:
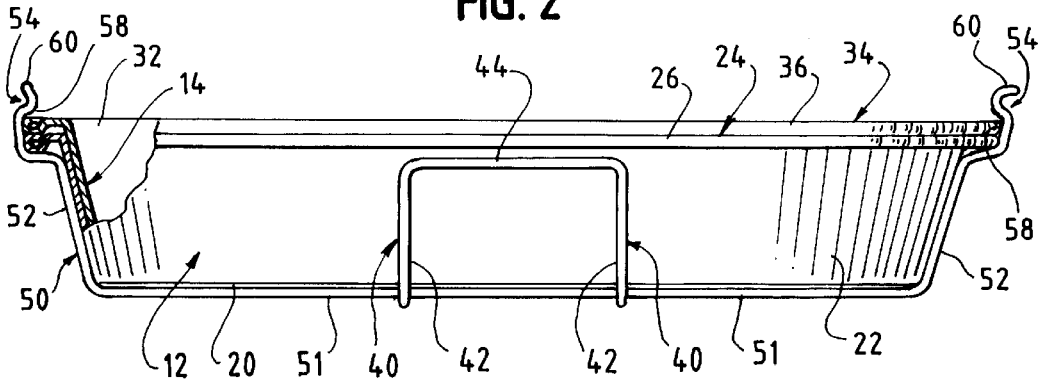
FIG. 2 is a side view of the assembly of FIG. 1 with a left-hand comer portion broken away and shown in cross-section.
Figure 3:
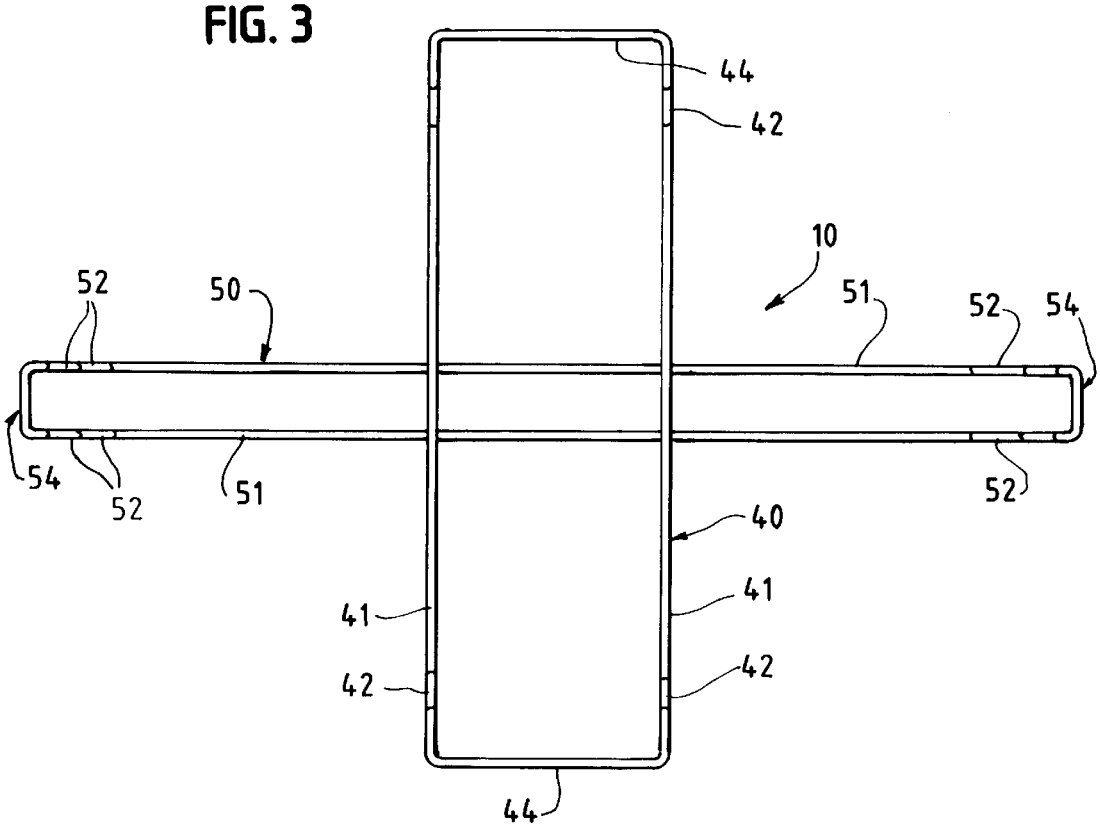
FIG. 3 is a top plan view of the wire roasting rack of FIG. 1
Figure 4:
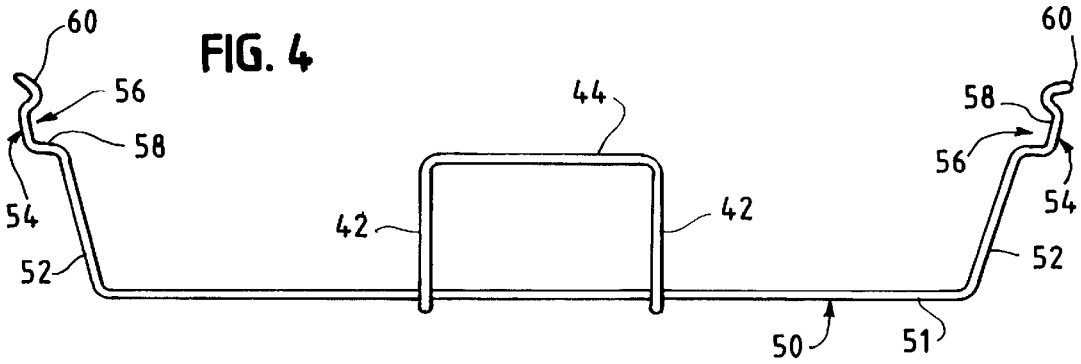
FIG. 4 is a end view of the wire rack of FIG. 1.
Figure 5:
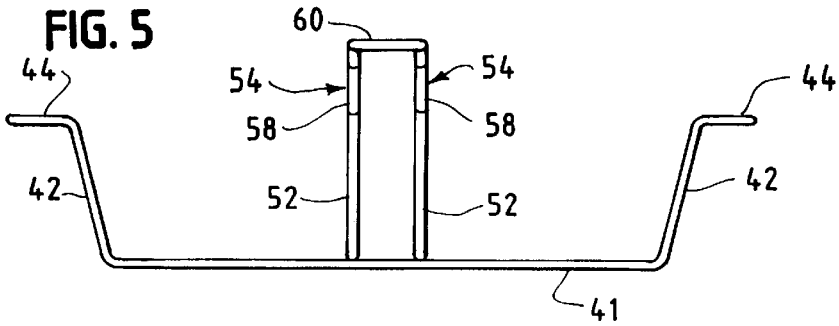
FIG. 5 is a side view of the wire roasting rack of FIG. 1.
Figure 6:
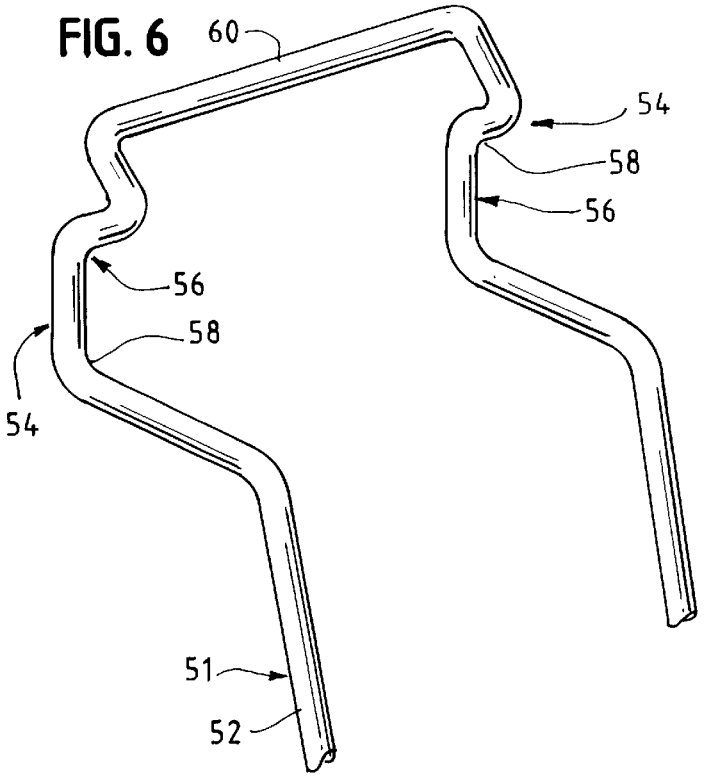
FIG. 6 is an enlarged perspective view of a fragmentary portion of FIG. 1.

Referring now to the drawings, FIG. 1 illustrates an assembled array of a wire form roasting rack 10 of the present invention and a pair of thin gauge stamped and formed aluminum foil roasting pan members. The roasting pan members may comprise a pair of substantially identical pans 12 and 14, each of which is adapted to be used interchangeably as a roasting pan member and as a cover member. Pans 12 and 14 may be anyone of a variety of conventionally available pans.

The first pan 12, which may be used as a roasting pan, generally comprises a bottom wall or base 20, a continuous upstanding sidewall 22 and a rim 24. Rim 24 terminates outwardly in a rolled-over lip or peripheral bead 26 defining the border of the pan 12. The second pan 14, which may be used as a roasting pan cover, generally comprises a bottom wall or base 30, a continuous upstanding sidewall 32 and a rim 34. Rim 34 terminates outwardly in a rolled-over lip or peripheral bead 36 defining the border of cover 14. It will be apparent that the second pan 14 which serves as a cover may be used as pan 12 and vice-versa, especially when they are essentially identical. Alternatively, the second pan 14 which serves as the cover may be shallower if desired. The bases 22 and 32 of the pans 12, 14 may be formed to define recesses R for receiving juices and to elevate the foods to be cooked therein above the lowest reaches of the bases, thereby to promote heat distribution and cooking and to retain juices, as well as to provide enhanced strength and stability to the pans.

Figure 8:
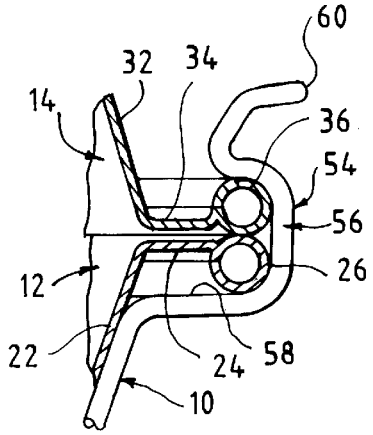
FIG. 8 is an enlarged fragmentary view of FIG. 7 taken substantially along line 7—7 of FIG. 7.
Figure 7:
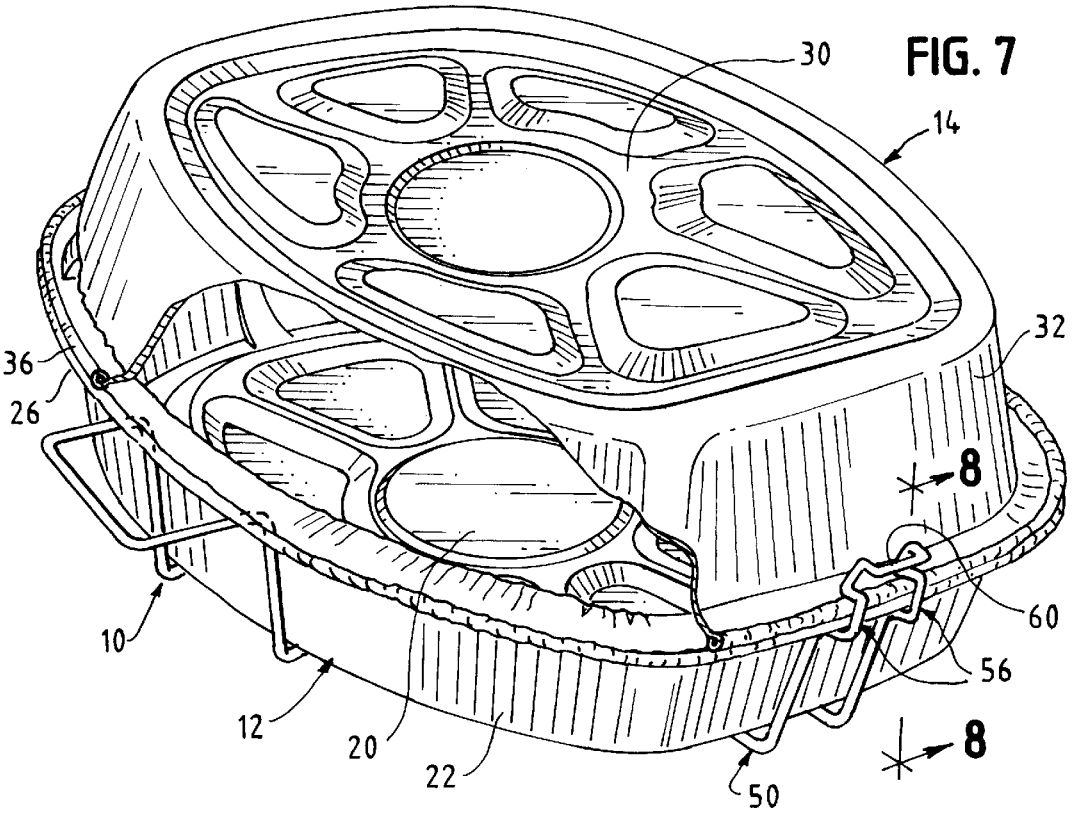
FIG. 7 is a perspective view, partially broken away, of an assembly present of wire roasting a rack of the invention, an associated roasting pan and an identical pan secured as a cover thereto.

Referring now to the wire form roasting rack 10, it is seen to serve as a frame for receiving a roasting pan 12 and for stably supporting a roasting pan 12, such as when it is introduced into and removed from an oven. The rack 10 includes a pair of parallel wire members 40, each comprising an elongated wire which terminates at form section 41 opposite ends in upwardly extending portions 42. Pairs of portions 42 provide outwardly extending handles 44 which join the portions 42 at each end. Handles 44 preferably closely underlie and support the rim 24 when the base 20 of the pan 12 is supported on the wire sections 41. The wire members 40 may be continuous and brazed or welded to form a unitary assemblage or may comprise a pair of generally similar members which are U-shaped in plan view and which are brazed or welded at points of overlap to form a unitary handle assembly which extends across the width of an associated roasting pan generally as illustrated in FIG. 8 of U.S. Pat. No. 4,852,760.

The rack 10 further comprises a second elongated wire form member 50 which is transverse to the first wire form member 40. Wire form member 50 extends lengthwise of the rack 10 and is brazed or welded to wire form member 40 to form an integrated assembly. Wire form member 50 may comprise a pair of parallel wire form sections 51 which are closer to each other than are the wire form sections 41. Wire form sections 51 terminate at opposite ends in upwardly extending portions 52. Portions 52, at each end of the wire form member 50, provide a lip or bead gripping formation 54 and an actuator 60 for retracting the bead gripping formation 54.

As will be appreciated, the wire form sections 41, 51 lie in a substantially common plane and serve to provide a support for the base 20 of a roasting pan in use. The upwardly extending portions 42, 52 of the wire form members nestingly receive and support the sidewall 22 of a roasting pan in use. The handles 44 underlie the rim 24 of the roasting pan 12 and serve to help support pans and covers associated with the rack and the contents of the pan in use.

In accordance with the present invention, the bead gripping formations 54 comprise an inwardly opening gripper means 56 which, in the embodiment illustrated, comprises, at each end of the member 51, a pair of laterally spaced inwardly opening loops 58. Loops 58 are sized, in a vertical direction, to receive a pair of pan lips or beads 26, 36 and to assist in maintaining them in an overlying relationship. To that end, when the rack and a pair of pans/covers are assembled as illustrated in FIG. 1, as for shipment as a unit from the factory, the assembly retains the pans in the assembled array for shipment and for handling, as in a retail establishment. After an assembled array is purchased for use, the pan covers may be removed, or the cover only may be removed, for use. They may be removed by retracting one or both actuators 60. to release the beads 26, 36 from the loops 58.

Assuming roasting pan 12 is in an assembled relationship with a roasting rack 10 and that the contents to be cooked in the pan have been placed in the pan, a cover 14 may be re-associated with the array as by inverting a cover 14, retracting a bead gripping formation, and positioning the cover to overlie the pan with the beads 26, 36 within the gripper means 56 of the bead gripping formation 54, thereby to retain the rims 24, 34 in an overlying confronting relationship.

The roasting pans and covers 12 and 14 may be of a variety of types. In the preferred form, they are of a thin gauge stamped and formed aluminum foil, desirably having rolled lips or beads and suitable formations, as illustrated, in their bases to facilitate cooking. They may be oval as illustrated, or may be square or rectangular in plan view. They may be of different sizes, such as about 14"×18" in plan view, about 10"×12" in plan view, etc. They may have different pan depths, such as depths of 2½" and 3", and the covers and pans may be identical or may have different depths. Preferably the covers and pans are of the same material, although a transparent plastic cover could be used in association with an aluminum foil pan for display purposes.

Figure 9:
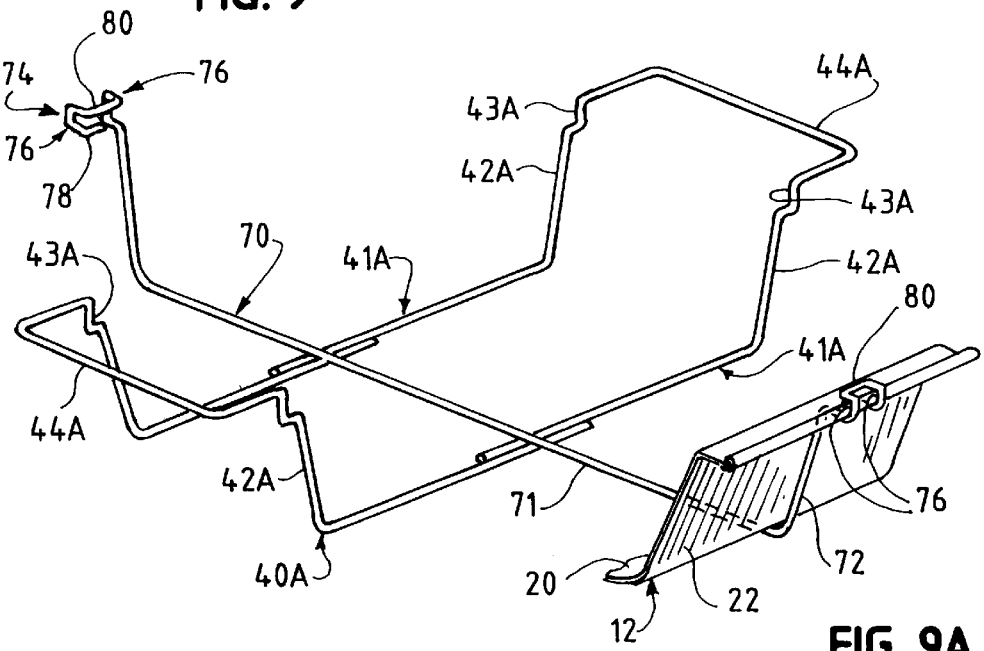
FIG. 9 and 9A are perspective and fragmentary cross-sectional views of an alternative wire form roasting rack of the present invention.
Figure 9A:
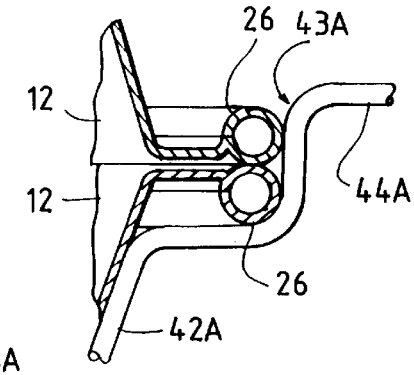

In the embodiment of FIGS. 1–8, the wire form member 50 is shown as comprising a pair of wire form sections 51. As shown in FIGS. 9 and 9A, an associated wire form member 70 may comprise a single wire form section 71 having upwardly extending portions 72 and at each end of the member 70, a bead gripping formation 74 shaped and formed to, provide a gripper means 76 comprising a pair of spaced-apart loops 78, and an actuator 80. Actuator 80 may be retracted to release pan and cover beads as was described in connection with retractor 60. The wire form member 70 may be substituted for a wire form member 50 and may be secured to a wire for member 40. A generally like wire form member 40, and which will function therewith as has been described above wire form member 40A may comprise wire form sections 41A, each terminating at opposite ends in upstanding portions 42A. Portions 42A define notch areas 43A which terminate upwardly in outwardly extending handles 44A. Handles 44A join portions 42A at each end. The notch areas 43A nestingly receive the rims at the sides of the roasting pan and are sized vertically so that when a pan 12 is inverted to serve as a cover overlying another pan 12, the beads 26 of the overlying pan and cover will be disposed within the notch area and will resist unintended lateral movement of the cover relative to the pan in the zones of the handles, all in cooperation with gripper means 76 at the ends of the assembly.

Figure 10:
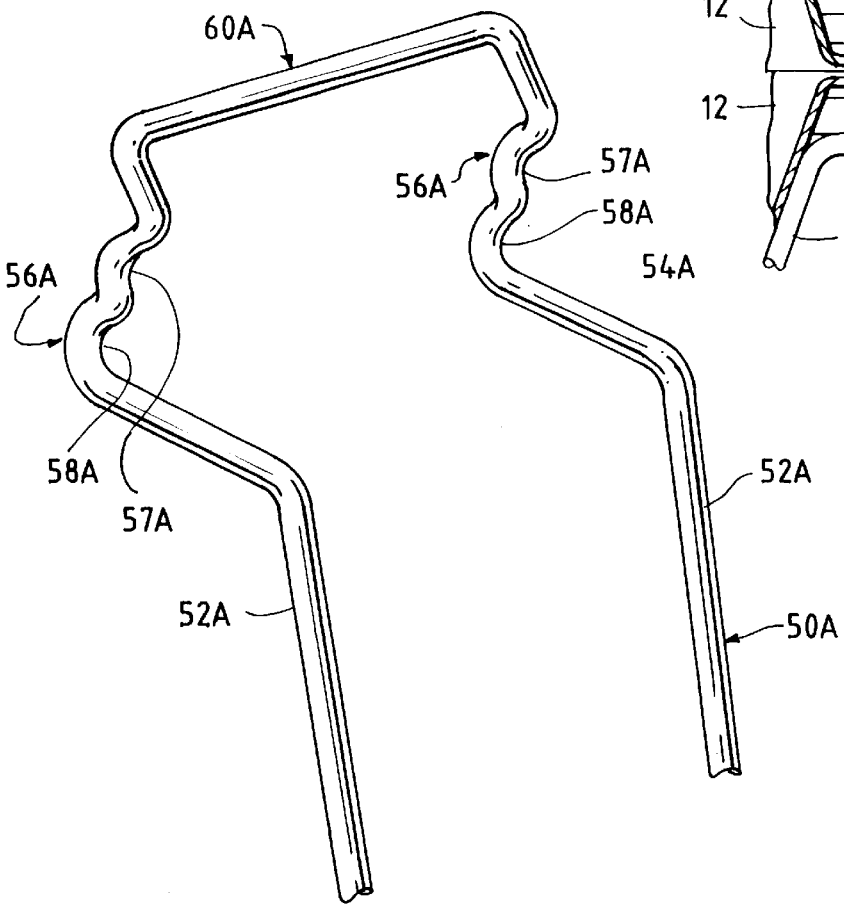
FIG. 10 is a perspective view of a further embodiment of a wire form member providing yet another bead gripping formation.
Figure 11:
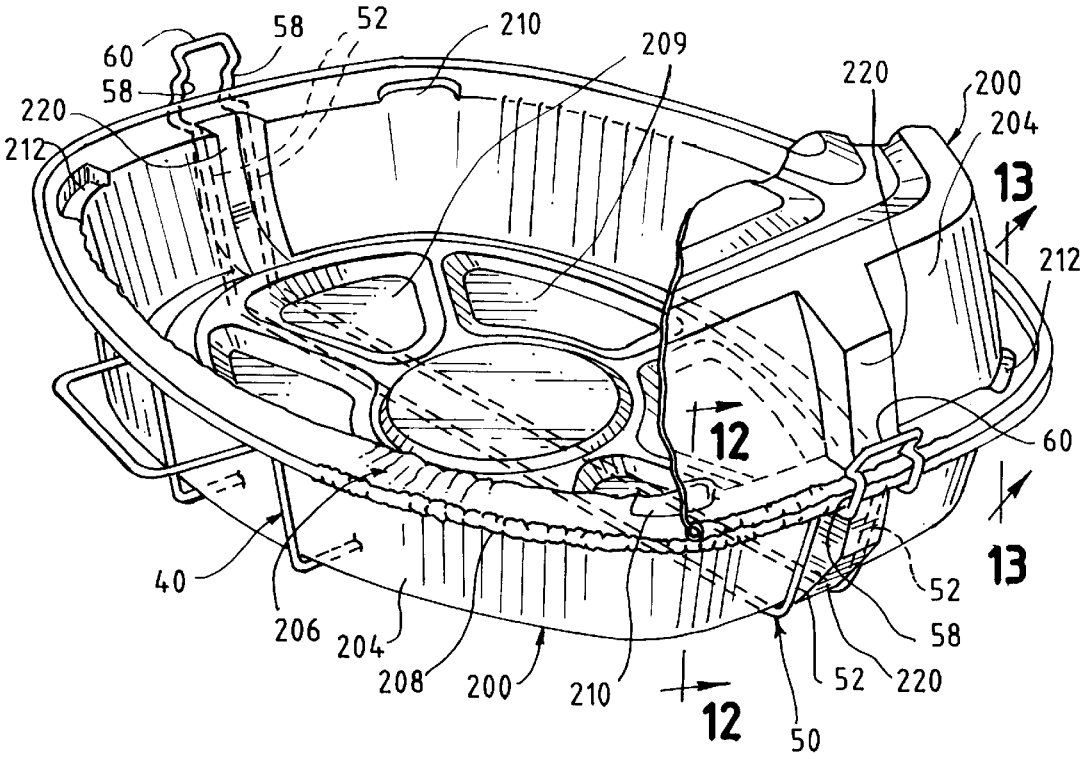
FIG. 11 is perspective view of an assembly of a formed wire roasting rack and another pan/cover associated therewith.
Figure 12:
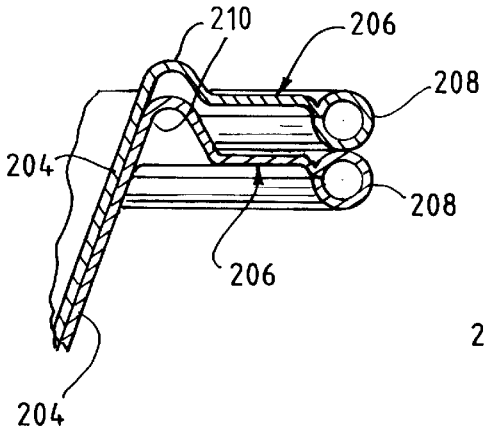
FIGS. 12 and 13 are cross-sectional views taken substantially along lines 12—12 and 13—13, respectively, of FIG. 11.
Figure 13:
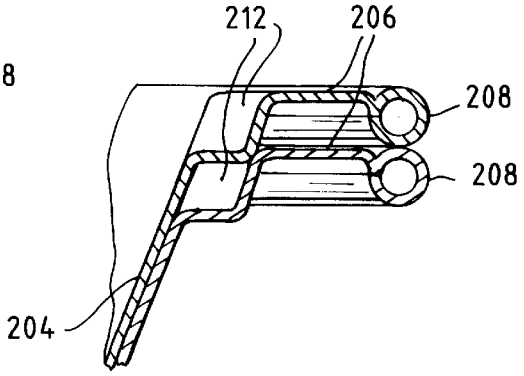

As shown in FIG. 10, a wire form member 50A having upwardly extending portions 52A may employ bead gripping formations 54A. Formations 54A comprise gripper means 56A which define vertically stacked, shaped receivers 57A and 58A which are shaped to provide a pair of vertically spaced recesses complementary to the pan and cover beads 26, 36 and which therefore and locate the beads 26, 36 in a seat controlled overlying relationship. An actuator 60A may be provided to retract the gripper means 56A in the described above regarding actuator 60. In all cases, it will be apparent that the locations of manner the wire and rack bead gripping formations are remote (90°away) from the handles. Thus, the bead gripping 44 formations tend to retain their gripping relationship with the pan beads, as distinguished from devices, such as those illustrated in D-333,235, in which the U.S. Des. Pat. handles associated with rim gripping elements and are improper manipulation of the handles can release the rim gripping elements, a serious safety concern. As stated, the rack and pan assembly of the present invention may employ a variety of pan/cover constructions which have a variety of functions and special purposes. Referring now to FIGS. 11–13, formed aluminum foil pans 200 which may serve as covers as well are seen to comprise abase 202, a sidewall 204 and a rim 206. Rim 206 terminates outwardly in a lip or rolled bead 208. Base 202 is formed to provide recesses 209 to receive juices during cooking and to enhance heat distribution. In addition to the rolled bead 208, rim 206 defines a series of formations, such as a plurality of tongues 210 and grooves 212 which are staggered or alternate so that a pair of juxtaposed pans and covers 200 will have at least two pairs of nested tongues 210 and grooves 212, thereby to hold the pair of pans and covers against lateral movement relative to each other.

Additionally, the sidewalls of the pans and covers may be formed with outwardly extending projections 220, one at each end of the pan. These projections increase the strength of sidewall 204 and also provide a pair of handles by which the pan or cover may be gripped if the pan is used with out a rack or when the cover is manipulated. The projections 220 are also desirably proportioned to be positioned between pairs of upwardly extending portions 42 of the wire form sections 41 of a rack 10.When such pan projections 220 are used, they "key" the pan to the rack 10, increase the stability of the array, and prevent lateral unintended or undesired translation or movement of the pan relative to the rack.

Figure 14:
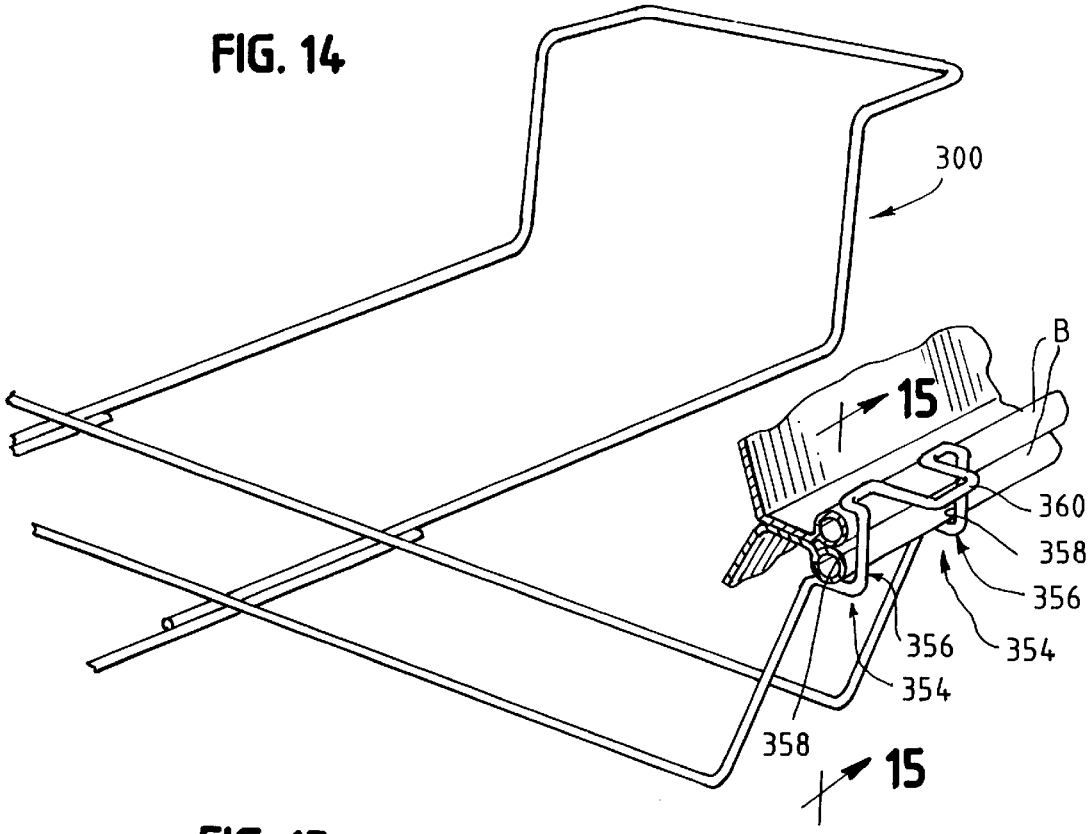
FIGS. 14, 15 and 16 are, respectively, a fragmentary view of a further wire roasting rack of the present, invention, a fragmentary side view of FIG. 14 and a fragmentary plan view of FIG. 14.
Figure 15:
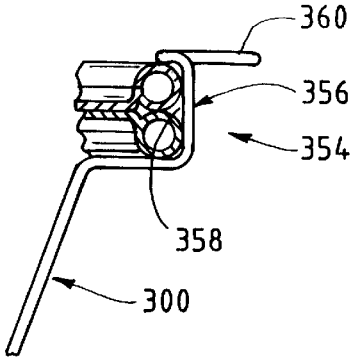
Figure 16:
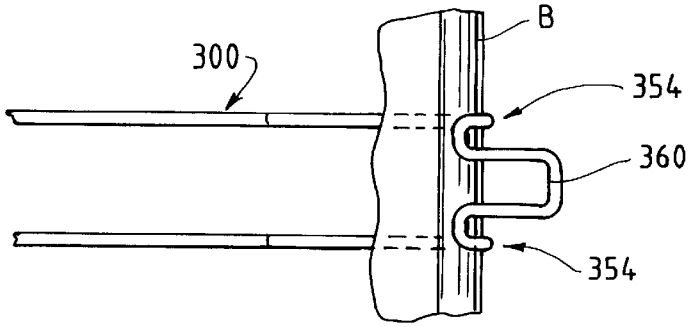

Referring now to FIGS. 14–16, a wire roasting rack 300 like rack 10 is there shown. It is identical in all respects except for the bead gripping formations 354 at the ends of upwardly extending portions 352. Formations 354 comprise an inwardly opening gripper means 356 having a pair of laterally spaced inwardly opening loops 358. Loops 358 are sized in a vertical direction to receive a pair of pan lips or beads B as schematically illustrated in FIGS. 14–16 to assist in maintaining the beads in an overlying relationship. Loop 358 may be retracted from the pan beads by retracting one or both actuators 360. Actuators 360, rather than extending straight across as did actuator 60, instead has a rearwardly extending U-shaped trigger (see FIGS. 14 and 15) which may be pushed down, as by a person's thumb, at the time a pan or cover is to be inserted or removed. This arrangement makes it possible to reduce the height of the rack (as compared to the rack of FIGS. 1–8) and provides enhanced access to the actuator. It will be apparent to those skilled in the art that changes and modifications may be made in the foregoing without departing from the spirit of the invention, the scope of which is defined by the appended claims.

What is claimed is:

1. An assembly comprising a formed wire roasting rack and a pair of formed foil roasting pan/cover members removably secured thereto, each said roasting pan/cover member having a base, an upstanding sidewall, a rim and a peripheral bead formation surrounding the rim, said roasting rack comprising a first pair of parallel elongated wire form sections terminating in upwardly extending portions providing outwardly extending wire handles, and a second elongated wire form section extending transverse to said first wire section and terminating in an upwardly extending portion at each end, each said upwardly extending portion of said second section providing a bead gripping formation at the free end thereof, and an actuator for retracting said bead gripping formation, said wire form sections being adapted to support said base in use, said upwardly extending portions being adapted to support and nestingly receive said sidewall, and said bead gripping formations being sized and proportioned to grippingly retain said pair of roasting pan/cover member bead formations, all in a nested array, to grippingly retain said pair of roasting pan/cover bead formations when one of the pan/covers is inverted to overlie and cover the other, and to release said pan/cover member bead formations for removal from the rack when a said actuator is retracted.

2. An assembly in accordance with claim 1 and wherein said roasting pan/cover members are substantially identical.

3. An assembly in accordance with claim 1 and wherein each said bead gripping formation comprises an inwardly opening gripper means.

4. An assembly comprising a wire roasting rack, a formed foil roasting pan and a formed foil roasting pan cover removably secured to the rack, said roasting pan having a pan base, an upstanding pan sidewall, a pan rim and a peripheral bead formation surrounding the pan rim, said cover having a cover dome, a cover sidewall, a cover rim and a peripheral bead surrounding the cover rim, said roasting rack comprising a first pair of elongated parallel wire form sections terminating in upwardly extending portions providing outwardly extending wire handles, and a second elongated wire form section extending transverse to said first wire section and terminating in an upwardly extending portion at each end, each upwardly extending portion of said second section providing a bead gripping formation at the free end thereof, and an actuator for retracting said bead gripping formation, said wire form sections being adapted to support said roasting pan base in use, said upwardly extending portions being adapted to support and nestingly receive said pan sidewall, and said bead gripping formations being sized and proportioned to grippingly retain said pair of roasting pan and cover bead formations, when said cover is inverted to overlay and cover the pan, and to release said cover for removal from the rack and from said base when a said actuator is retracted.

5. An assembly in accordance with claim 4 and wherein said roasting pan and cover members are substantially identical.

6. An assembly in accordance with claim 4 and wherein each said bead gripping formation comprises an inwardly opening gripper means.

7. A wire roasting rack for removably securing thereto a pair of formed foil roasting pan/cover members each having a base, an upstanding sidewall, a rim and a peripheral bead formation surrounding the rim, said roasting rack comprising a first pair of elongated wire form sections terminating in upwardly extending portions providing outwardly extending wire handles, and a second elongated wire form section extending transverse to said first wire section and terminating in an upwardly extending portion at each end, each said upwardly extending portion of said second section providing a bead gripping formation at the free end thereof, and each said upwardly extending portion of said second section providing an actuator above said bead gripping formation for retracting said bead gripping formation, said wire form sections being adapted to support a said base in use, said upwardly extending portions being adapted to support and nestingly receive said upstanding sidewall, and said bead gripping formations being sized and proportioned to grippingly retain a pair of roasting pan/cover beads, both when said cover and pan are in a nested array and when said cover is positioned to overlay and cover the pan, and to release said bead formations for removal from the rack when said actuator is retracted.

8. An assembly and accordance with claim 7 and wherein each said bead gripping formation comprises an inwardly opening gripper means.

* * * * *